US006746304B1

(12) United States Patent
Liu

(10) Patent No.: US 6,746,304 B1
(45) Date of Patent: Jun. 8, 2004

(54) REMOTE-CONTROL TOY CAR SET

(76) Inventor: Shu-Ming Liu, No. 32, Lane 75, Sec. 3, Kang-Ning Rd., Taipei City (TW)

( * ) Notice: Subject to any disclaimer, the term of this patent is extended or adjusted under 35 U.S.C. 154(b) by 0 days.

(21) Appl. No.: 10/412,802

(22) Filed: Apr. 14, 2003

(51) Int. Cl.[7] ..... A63H 30/00
(52) U.S. Cl. ..... 446/454; 446/456; 446/457
(58) Field of Search ..... 446/431, 456, 446/457, 460, 462

(56) References Cited

U.S. PATENT DOCUMENTS 4,817,948 A * 4/1989 Simonelli ..... 273/86 B
4,989,466 A * 2/1991 Goodman ..... 74/5.22
5,481,257 A * 1/1996 Brubaker et al. ..... 340/825.69
5,533,921 A * 7/1996 Wilkinson ..... 446/409
5,596,319 A * 1/1997 Spry ..... 340/903
5,823,845 A * 10/1998 O'Berrigan ..... 446/234
5,963,749 A * 10/1999 Nicholson ..... 396/421
6,293,798 B1 * 9/2001 Boyle et al. ..... 434/29
6,458,008 B1 * 10/2002 Hyneman ..... 446/259
6,497,608 B2 * 12/2002 Ho et al. ..... 446/456
6,535,793 B2 * 3/2003 Allard ..... 700/259
2001/0045978 A1 * 11/2001 McConnell et al. ..... 348/42

* cited by examiner

*Primary Examiner*—Ali Abdelwahed
(74) *Attorney, Agent, or Firm*—Bacon & Thomas, PLLC

(57) ABSTRACT

A remote-control toy car set includes a toy car, and a remote-control device. The toy car includes a body, a driving device, a stabilizer, a camera system, a sensor, and a first radio module. The remote-control device includes a servo device, a display, a remote-control interface, and a second radio module. Thus, the level indication image is directed toward the inclined direction of the toy car, so that the user can manipulate the toy car to roll in the direction opposite to the inclined direction of the toy car to compensate inclination of the inclined level indication image, so as to guide the toy car to return to the level stable state.

6 Claims, 7 Drawing Sheets

REMOTE-CONTROL TOY CAR SET

BACKGROUND OF THE INVENTION

1. Field of the Invention

The present invention relates to a remote-control toy car set, and more particularly to a remote-control toy car set, wherein the servo device drives the display to simulate movement of the toy car, so that the user can simulate the instant position lively.

2. Description of the Related Art

A conventional remote-control toy car 100 shown in FIG. 1 is provided with a camera system 101 mounted in the remote-control toy car 100.

Referring to FIGS. 2A and 2B, the display 102 shows the view 103 before the remote-control toy car 100, and the view 103 is taken by the camera system 101.

Referring to FIGS. 3A and 3B, the remote-control toy car 100 is rolled and inclined in the clockwise direction "C1". At this time, the camera system 101 is fixed in the remote-control toy car 100, so that when the remote-control toy car 100 is inclined in the clockwise direction "C1", the camera system 101 is also inclined in the clockwise direction "C1". In such a manner, the view 103 taken by the camera system 101 is inclined in the counterclockwise direction "C2" which is opposite to the inclined direction of the remote-control toy car 100. Thus, when the user sees that the view 103 taken by the camera system 101 is inclined in the counterclockwise direction "C2", the user naturally wishes to control the remote-control toy car 100 to roll in the clockwise direction "C1" to compensate inclination of the remote-control toy car 100, so that the remote-control toy car 100 is further inclined in the clockwise direction "C1" and easily falls down or tips over.

SUMMARY OF THE INVENTION

The present invention is to mitigate and/or obviate the disadvantage of the conventional remote-control toy car.

The primary objective of the present invention is to provide a remote-control toy car set, wherein the level indication image is directed toward the inclined direction of the toy car, so that the user can manipulate the toy car to roll in the direction opposite to the inclined direction of the toy car to compensate inclination of the inclined level indication image, so as to guide the toy car to return to the level stable state.

Another objective of the present invention is to provide a remote-control toy car set, wherein the servo device drives the display to simulate movement of the toy car, so that the user can simulate the instant position lively.

In accordance with one aspect of the present invention, there is provided a remote-control toy car set, comprising:

- a toy car including:
  - a body;
  - a driving device mounted in the body for driving the toy car;
  - a stabilizer mounted in the body;
  - a camera system mounted on the stabilizer;
  - a sensor mounted on the stabilizer; and
  - a first radio module mounted in the body and electrically connected to the driving device, the camera system and the sensor;
- a remote-control device includes:
  - a servo device;
  - a display mounted on the servo device;

- a remote-control interface; and
  - a second radio module electrically connected to the display, the remote-control interface and the servo device; wherein:
    - the user controls the remote-control interface of the remote-control device to control the driving device to drive the toy car to move;
    - the camera system takes the views on the travel direction to produce a corresponding image signal which is sent to the display which shows the images corresponding to the image signal;
    - the sensor of the toy car detects movement of the toy car relative to a predetermined fixed direction to produce a corresponding sensing signal and send the sensing signal to the servo device;
    - the servo device drives the display according to the sensing signal to simulate the movement corresponding to the toy car; and
    - the stabilizer maintains the plumb direction of the camera system in line with the gravity direction.

Further benefits and advantages of the present invention will become apparent after a careful reading of the detailed description with appropriate reference to the accompanying drawings.

DETAILED DESCRIPTION OF THE INVENTION

Figure 1:
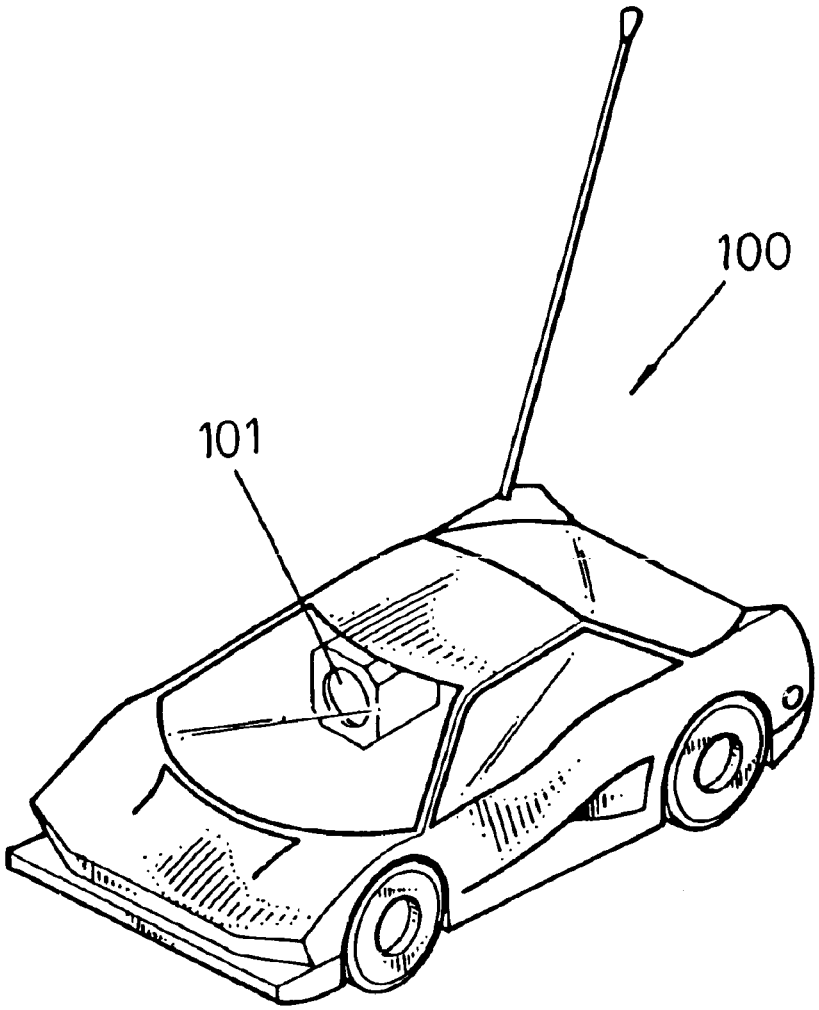
FIG. 1 (PRIOR ART)
FIG. 1 is a perspective view of a conventional remote-control toy car in accordance with the prior art.
Figure 2A:
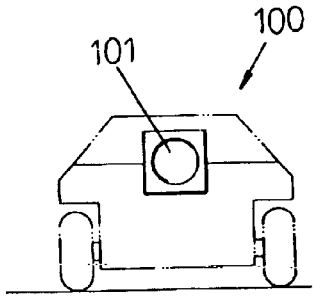
FIG. 2A (PRIOR ART)
FIG. 2A is a rear plan view of the conventional remote-control toy car as shown in FIG. 1.
Figure 2B:
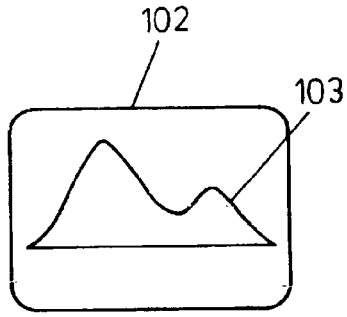
FIG. 2B (PRIOR ART)
FIG. 2B is a schematic view of a display of the conventional remote-control toy car as shown in FIG. 2A.
Figure 3A:
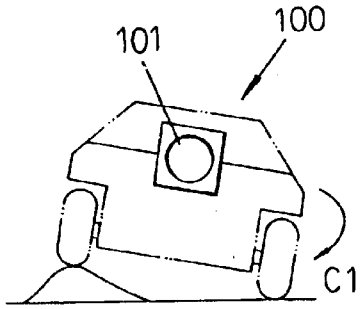
FIG. 3A (PRIOR ART)
FIG. 3A is a schematic operational view of the conventional remote-control toy car as shown in FIG. 2A.
Figure 3B:
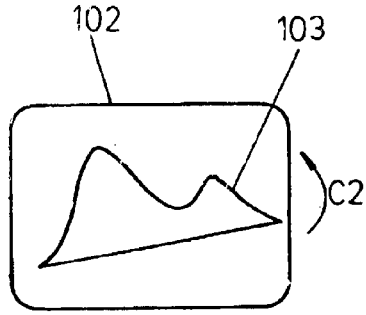
FIG. 3B (PRIOR ART)
FIG. 3B is a schematic operational view of the conventional remote-control toy car as shown in FIG. 2B.
Figure 4:
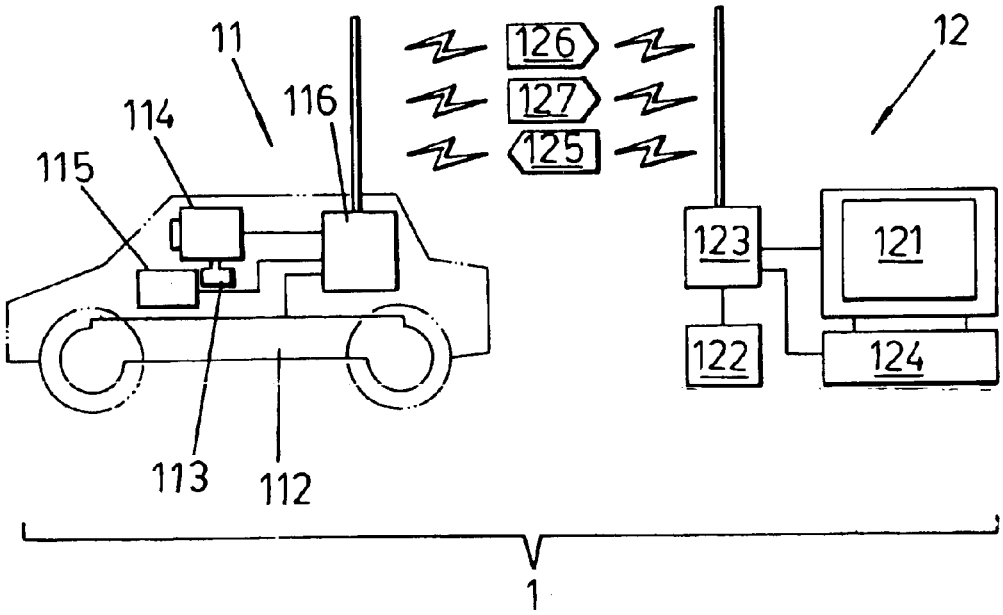
FIG. 4 is a block view of a remote-control toy car set in accordance with the preferred embodiment of the present invention.
Figure 5:
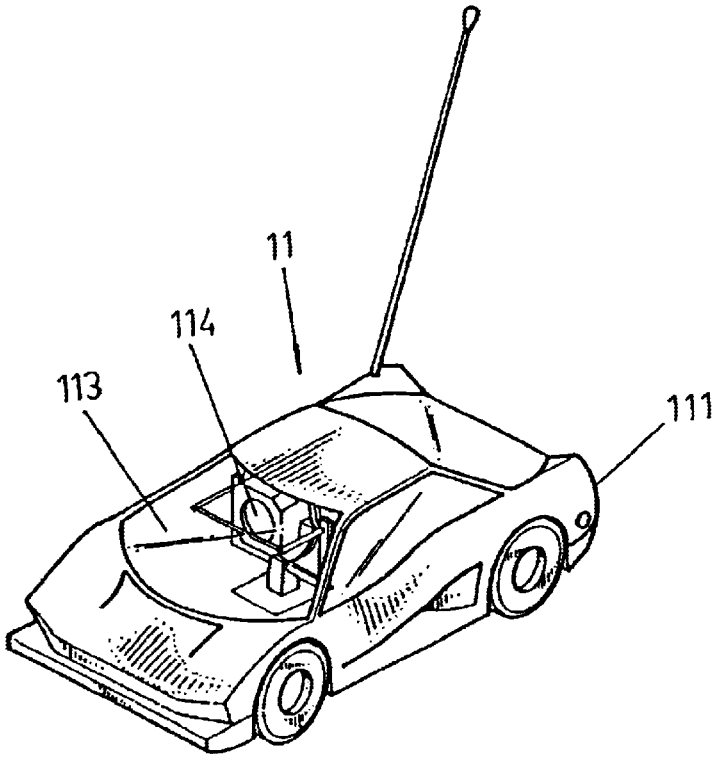
FIG. 5 is a perspective view of the remote-control toy car set in accordance with the preferred embodiment of the present invention.

Referring to the drawings and initially to FIGS. 4 and 5, a remote-control toy car set 1 in accordance with the preferred embodiment of the present invention comprises a toy car 11, and a remote-control device 12.

The toy car 11 includes a body 111, a driving device 112 mounted in the body 111 for driving the toy car 11, a stabilizer 113 mounted in the body 111, a camera system 114 mounted on the stabilizer 113, a sensor 115 mounted on the stabilizer 113, and a first radio module 116 mounted in the body 111 and electrically connected to the driving device 112, the camera system 114 and the sensor 115. Preferably, the camera system 114 uses a charge coupled device (CCD).

The remote-control device 12 includes a servo device 124, a display 121 mounted on the servo device 124, a remote-control interface 122, and a second radio module 123 electrically connected to the display 121, the remote-control interface 122 and the servo device 124.

In operation, when the user controls the remote-control interface 122 of the remote-control device 12, the remote-control interface 122 produces a corresponding control signal 125 and sends the control signal 125 to the second radio module 123 which transmits the control signal 125 in a wireless manner. After the first radio module 116 of the toy car 11 receives the wireless control signal 125, the first radio module 116 sends the control signal 125 to the driving device 112 which drives the toy car 11 to perform the action corresponding to the control signal 125, such as forward, backward, turning, acceleration or the like. On the other hand, the camera system 114 of the toy car 11 takes the views on the travel direction to produce a corresponding image signal 126 and to send the image signal 126 to the first radio module 116 which transmits the image signal 126 in a wireless manner. After the second radio module 123 of the remote-control device 12 receives the wireless image signal 126, the second radio module 123 sends the image signal 126 to the display 121 which shows the images corresponding to the image signal 126. Thus, the user can use the remote-control interface 122 of the remote-control device 12 to control movement of the toy car 11 and can see the views on the travel direction by the display 121 of the remote-control device 12. Preferably, the display 121 is a liquid crystal display (LCD).

In addition, the sensor 115 of the toy car 11 can detect movement of the toy car 11 relative to a predetermined fixed direction, such as the direction of the gravity. Thus, when the toy car 11 is moving, the body 111 produces different movements relative to the predetermined fixed direction. At this time, the sensor 115 of the toy car 11 detects the movement of the toy car 11 relative to the predetermined fixed direction, and then produces a corresponding, sensing signal 127 and sends the sensing signal 127 to the first radio module 116 which transmits the sensing signal 127 in a wireless manner. After the second radio module 123 of the remote-control device 12 receives the wireless sensing signal 127, the second radio module 123 sends the sensing signal 127 to the servo device 124 which drives the display 121 to simulate the movement corresponding to the toy car 11, such as rolling, pitch or the like, so that the user can feel movement of the toy car 11.

Figure 6:
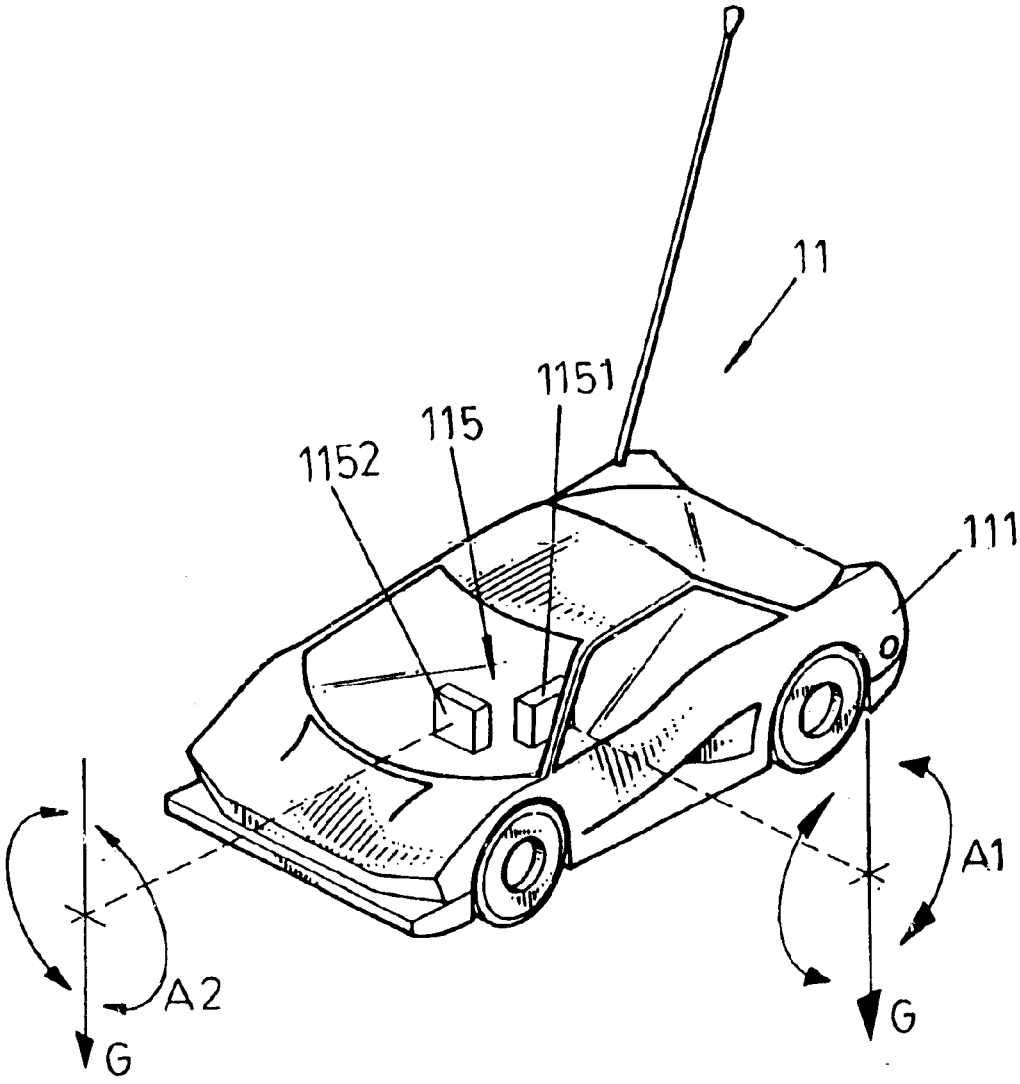
FIG. 6 is a schematic operational view of the remote-control toy car set as shown in FIG. 5.

Referring to FIG. 6, the sensor 115 includes, two gyroscopes 1151 and 1152, wherein the gyroscope 1151 can detect the pitch movement "A1" of the toy car 11 relative to the gravity direction "G", and the gyroscope 1152 can detect the rolling movement "A2" of the toy car 11 relative to the gravity direction "G". After the two gyroscopes 1151 and 1152 detect the respective movement, the two gyroscopes 1151 and 1152 send the corresponding sensing signal 127 respectively.

Figure 7:
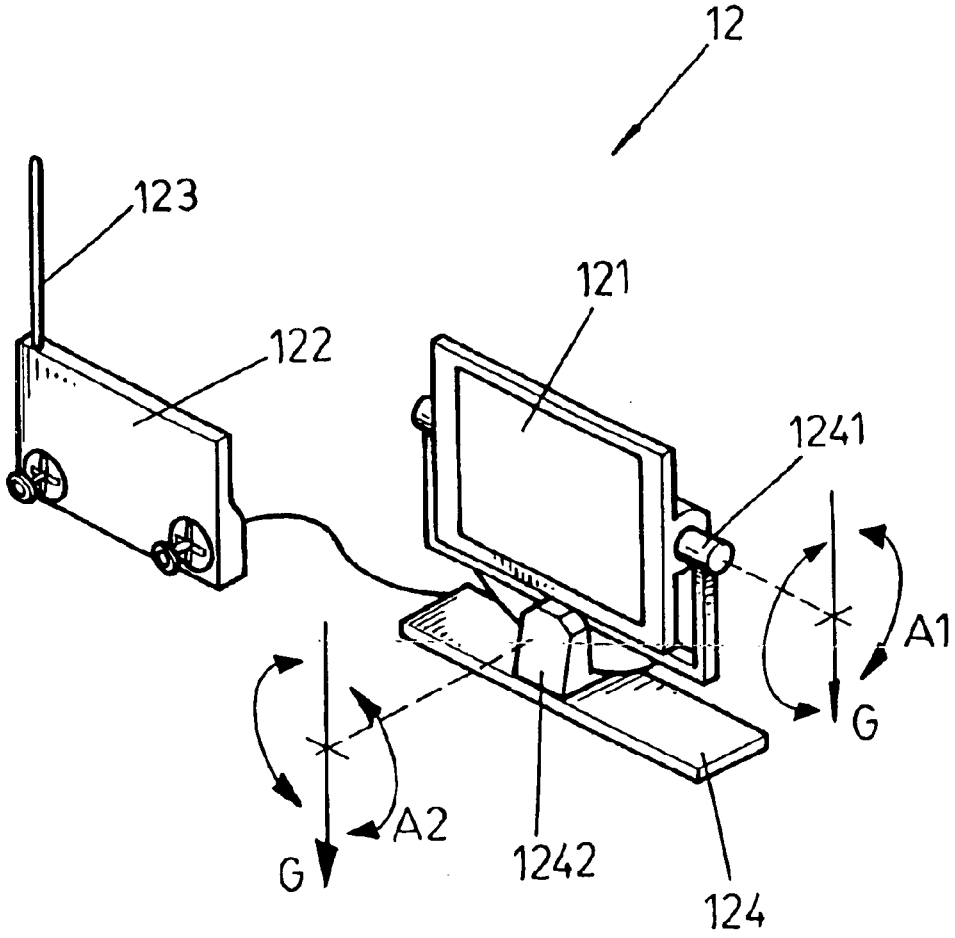
FIG. 7 is a perspective view of a remote-control device of the remote-control toy car set in accordance with the preferred embodiment of the present invention.

Referring to FIG. 7, the servo device 124 includes two servo motors 1241 and 1242, wherein the servo motor 1241 mates with the gyroscope 1151 to drive the display 121 to simulate the pitch movement "A1" of the toy car 11 relative to the gravity direction "G", and the servo motor 1242 mates with the gyroscope 1152 to drive the display 121 to simulate the rolling movement "A2" of the toy car 11 relative to the gravity direction "G". Thus, the gyroscope 1151 of the sensor 115 of the toy car 11 sends the sensing signal 127 through the first radio module 116 and the second radio module 123 to the servo motor 1241 of the servo device 124 which drives the display 121 to simulate the pitch movement "A1" of the toy car 11 relative to the gravity direction "G", and the gyroscope 1152 of the sensor 115 of the toy car 11 sends the sensing signal 127 through the first radio module 116 and the second radio module 123 to the servo motor 1242 of the servo device 124 which drives the display 121 to simulate the rolling movement "A2" of the toy car 11 relative to the gravity direction "G".

Figure 8A:
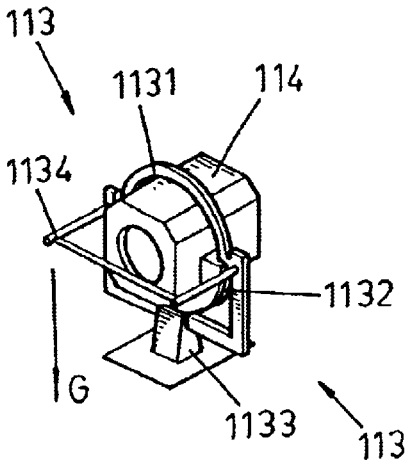
FIG. 8A is a perspective view of a stabilizer of the remote-control toy car set in accordance with the preferred embodiment of the present invention.
Figure 8B:
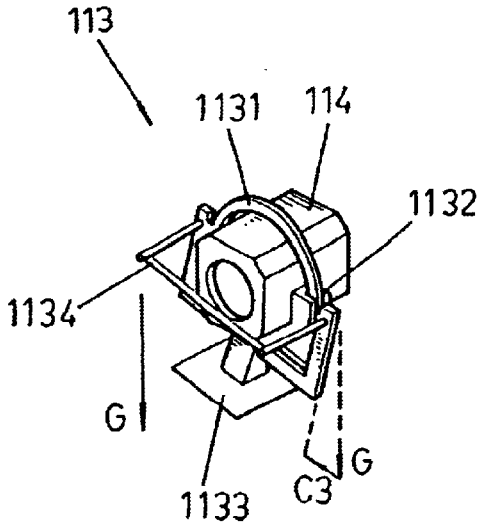
FIG. 8B is a schematic operational view of the stabilizer of the remote-control toy car set as shown in FIG. 8A.

Referring to FIGS. 8A and 8B, the stabilizer 113 includes a fixed seat 1133 secured in the body 111, a ring-shaped fulcrum 1131 secured on the fixed seat 1133, a suspension 1132 movably mounted on the fulcrum 1131 for supporting the camera system 114, and a level indicator 1134 fixed on the fulcrum 1131. When the body 111 (not shown in FIG. 8B) is inclined toward the direction indicated by the arrow "C3" as shown in FIG. 8B, the fulcrum 1131 is also inclined toward the direction indicated by the arrow "C3". At this time, the weight of the suspension 1132 movably mounted on the fulcrum 1131 maintains the plumb direction of the camera system 114 in line with the gravity direction "G", so that the plumb direction of the camera system 114 is constantly directed toward the gravity direction "G" without being affected by inclination of the body 111. On the contrary, the level indicator 1134 is moved with inclination of the body 111 to indicate the level of the body 111.

Figure 9A:
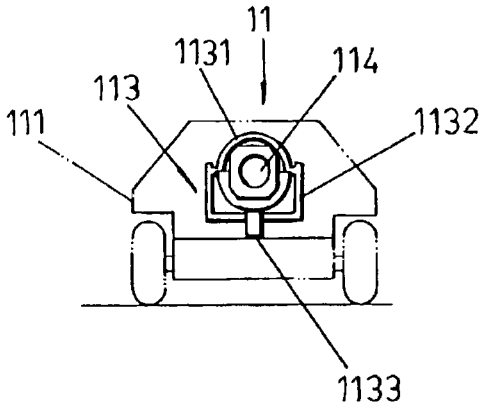
FIG. 9A is a schematic rear plan view of the remote-control toy car set as shown in FIG. 5.
Figure 9B:
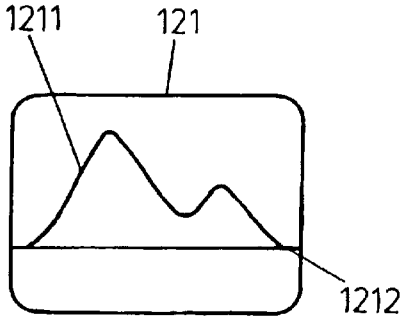
FIG. 9B is a schematic view of a display of the remote-control toy car as shown in FIG. 9A.

Referring to FIGS. 9A and 9B, the display 121 shows the view 1211 before the toy car 11. In addition, the level indicator 1134 before the camera system 114 produces a corresponding level image signal, so that the display 121 shows a level indication image 1212.

Figure 10A:
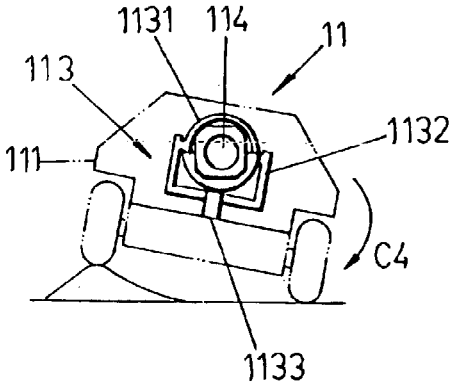
FIG. 10A is a schematic operational view of the remote-control toy car set as shown in FIG. 9A.
Figure 10B:
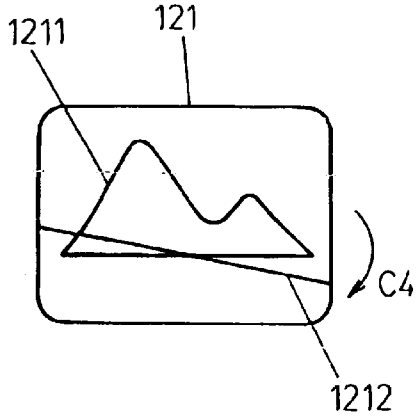
FIG. 10B is a schematic operational view of the remote-control toy car set as shown in FIG. 9B.

Referring to FIGS. 10A and 10B, the toy car 11 is rolled and inclined in the clockwise direction "C4", the plumb direction of the camera system 114 on the stabilizer 113 is directed toward the gravity direction "G" without being affected by inclination of the body 111, so that the display 121 as shown in FIG. 10B shows a view 1211 the same as that shown in FIG. 9B. In contrast, the level indicator 1134 is moved with inclination of the body 111 to indicate the level of the body 111, so that the level indication image 1212 as shown in FIG. 10B is also inclined in the clockwise direction "C4". Thus, the user can manipulate the toy car 11 to roll in the counterclockwise direction to compensate inclination of the inclined level indication image 1212, so as to guide the toy car 11 to the level stable state.

Accordingly, the level indication image 1212 is directed toward the inclined direction of the toy car 11, so that the user can manipulate the toy car 11 to roll in the direction opposite to the inclined direction of the toy car 11 to compensate inclination of the inclined level indication image 1212, so as to guide the toy car 11 to return to the level stable state.

Figure 11:
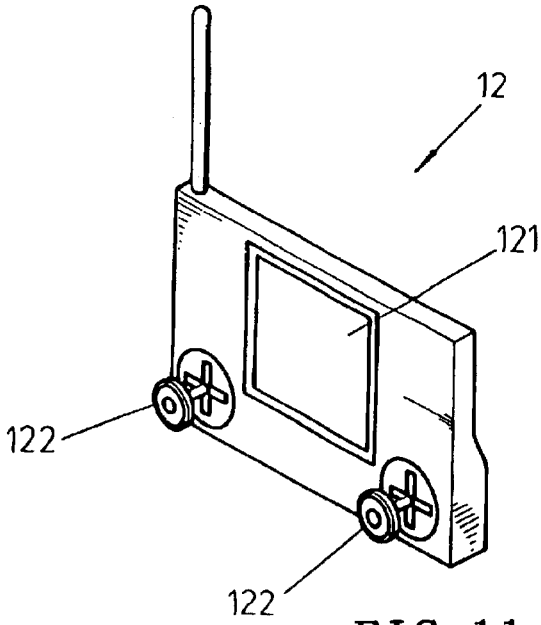
FIG. 11 is a perspective view of the remote-control device of the remote-control toy car set in accordance with another embodiment of the present invention.

Referring to FIG. 11, the user can use the remote-control interface 122 of the remote-control device 12 to control movement of the toy car 11 and can see the views on the travel direction by the display 121 of the remote-control device 12.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A remote-control toy car set, comprising:

a toy car including:

a body;

a driving device mounted in the body for driving the toy car;

a stabilizer means mounted in the body;

a camera system mounted on the stabilizer means;

a sensor mounted on the stabilizer means; and a first radio module mounted in the body and electrically connected to the driving device, the camera system and the sensor;

a remote-control device includes:

a servo device;

a display mounted on the servo device;

a remote-control interface; and a second radio module electrically connected to the display, the remote-control interface and the servo device; wherein:

a user controls the remote-control interface of the remote-control device to control the driving device to drive the toy car to move;

the camera system takes views on travel direction of the toy car to produce a corresponding image signal which is sent to the display which shows images corresponding to the image signal;

the sensor of the toy car detects movement of the toy car relative to a predetermined fixed direction to produce a corresponding sensing signal and sends the sensing signal to the servo device;

the servo device drives the display according to the sensing signal to simulate the movement corresponding to the toy car; and the stabilizer means maintains a plumb direction of the camera system in line with direction of gravity.

2. The remote-control toy car set in accordance with claim 1, wherein the stabilizer means includes a fulcrum secured in the body, and a suspension movably mounted on the fulcrum for supporting the camera system.

3. The remote-control toy car set in accordance with claim 1, wherein the stabilizer means includes a level indicator fixed on a fulcrum secured in the body to produce a level indication image in the display.

4. The remote-control toy car set in accordance with claim 1, wherein the sensor includes at least one gyroscope.

5. The remote-control toy car set in accordance with claim 1, wherein the camera system uses a charge coupled device (CCD).

6. The remote-control toy car set in accordance with claim 1, wherein the display is a liquid crystal display (LCD).

* * * * *